US005122942A

United States Patent [19]

Lee

[11] Patent Number: 5,122,942

[45] Date of Patent: Jun. 16, 1992

[54] LAMP SHADE STRUCTURE FOR MOUNTING A SNAP-SOCKET

[76] Inventor: Hsuan-Yu Lee, P.O. Box 96-405, Taipei 10098, Taiwan

[21] Appl. No.: 787,231

[22] Filed: Nov. 4, 1991

[51] Int. Cl.[5] ..... F21V 11/00

[52] U.S. Cl. ..... 362/353; 362/439

[58] Field of Search ..... 362/353, 439

[56] References Cited

U.S. PATENT DOCUMENTS 4,998,193 3/1991 Chuing-Hui ..... 362/353

*Primary Examiner*—Carroll B. Dority

[57] ABSTRACT

A lamp shade structure for easily mounting a snap-socket; the socket has two symmetrical hook grooves on the outer lower part thereof to facilitate connection with a lower shade portion, which is cup-shaped member with a screw hole in the center thereof, and two symmetrical snap fasteners; each of the snap fasteners has a hook to be engaged with the corresponding hook grooves so as to have the socket mounted on the lower shade portion in a simple and snap manner.

8 Claims, 4 Drawing Sheets

LAMP SHADE STRUCTURE FOR MOUNTING A SNAP-SOCKET

BACKGROUND OF THE INVENTION

1. Field of the Invention

This invention relates to a lamp, and particularly to a lamp, in which the shade portion and the socket assembly can be connected together by means of snap fasteners.

2. Description of the Prior Art

In the conventional lamps, the lamp shade usually has a center hole for connecting a rod, which has an outer threaded part at one end; the rod is then fixed in place with a nut. A socket is mounted in the lamp shade with screws. The power wires pass through the lamp base, the connecting rod, the lamp shade and the socket. Usually, the wires are separated after passing through the lamp shade, and are connected with the socket which is then fixed to the lamp shade with screws; in other words, such a conventional lamp is featured that the lamp shade and the socket are to be mounted together by means of screws.

In another prior art, such as U.S. Pat. No. 2,521,448, a cup-shaped member has a round hole on the bottom thereof; the round hole is connected with a connecting pipe, which is then connected with a base. The cup-shaped member, the connecting pipe and the base are assembled together with a threaded rod, of which the upper end is fixed to the socket cap and the cup-shaped member by means of a threaded hole in the socket cap; the other end of the threaded rod is fixed to the base with a nut. The socket body is connected with power wires by separating the wires from the threaded rod before being connected with the two electrodes of the socket body; then, the socket body and the socket cap are assembled together by means of threads thereof. In such a conventional lamp, the power wires are subject to being twisted upon the socket body and the socket cap being turned for connection.

In still another U.S. Pat. No. 4,998,193, the lamp shade of the lamp has a round hole; both ends of the connecting rod of the lamp have outer threads respectively, of which the lower end passes a hole of the lamp shade, and is connected with a supporting frame with a nut; the upper end of the connecting rod is connected with a threaded hole in the socket cap. The power wires passing through the connecting rod are connected with the two electrodes in the socket body. Similarly, the power wires are to be twisted upon the socket body and the socket cap being screwed together.

In brief, most of the current lamps adopt the aforesaid method to have their lamp shades and sockets respectively connected together, or adopt a method derived from the aforesaid method. The lamp shade is to be mounted on the lamp either in the factory through rather complicated assembling steps, or the lamp shade and the socket are assembled together by a user with toals. Anyway, during such assembling steps, the power wires between the socket body and socket cap will be twisted to some extent.

SUMMARY OF THE INVENTION

This invention relates to an improvement of connection structure between the lamp shade and the socket assembly. The center of the lamp shade has a screw hole for receiving a connecting rod, and the bottom of the lamp shade has snap fasteners to be mated with hook grooves respectively so as to connect the lamp shade and the socket assembly together.

A feature of the present invention is that the lower shade portion of the lamp shade is a cup-shaped member with a screw hole in the center thereof for fitting a connecting rod. The outer circle of the screw hole is furnished with at least two symmetrical snap fasteners and two supporting plates; each of the snap fasteners has a hook. The snap fasteners are used for making a snap connection between the snap fasteners and the corresponding hook grooves on the outer surface of the socket body.

Another feature of the present invention is that the supporting plates in the lower shade portion are used for supporting against the lower end of the socket assembly after the same being mounted in place; i.e.; to maintain a given space between the socket assembly and the flat bottom of the lower shade portion for dissipation of heat in the socket assembly.

Still another feature of the present invention is that the lower shade portion is to be connected with an upper shade portion, or is extended outwards to form an upper shade portion by molding method.

A further feature of the present invention is that the lower shade portion has snap fasteners, being molded integrally, so as to facilitate the socket assembly having two symmetrical hook grooves to connect with the lower shade portion. The socket assembly may be a type, of which the upper end has outer threads, or a type which has no such outer threads.

DETAILED DESCRIPTION OF THE PREFERRED EMBODIMENTS

Figure 1:
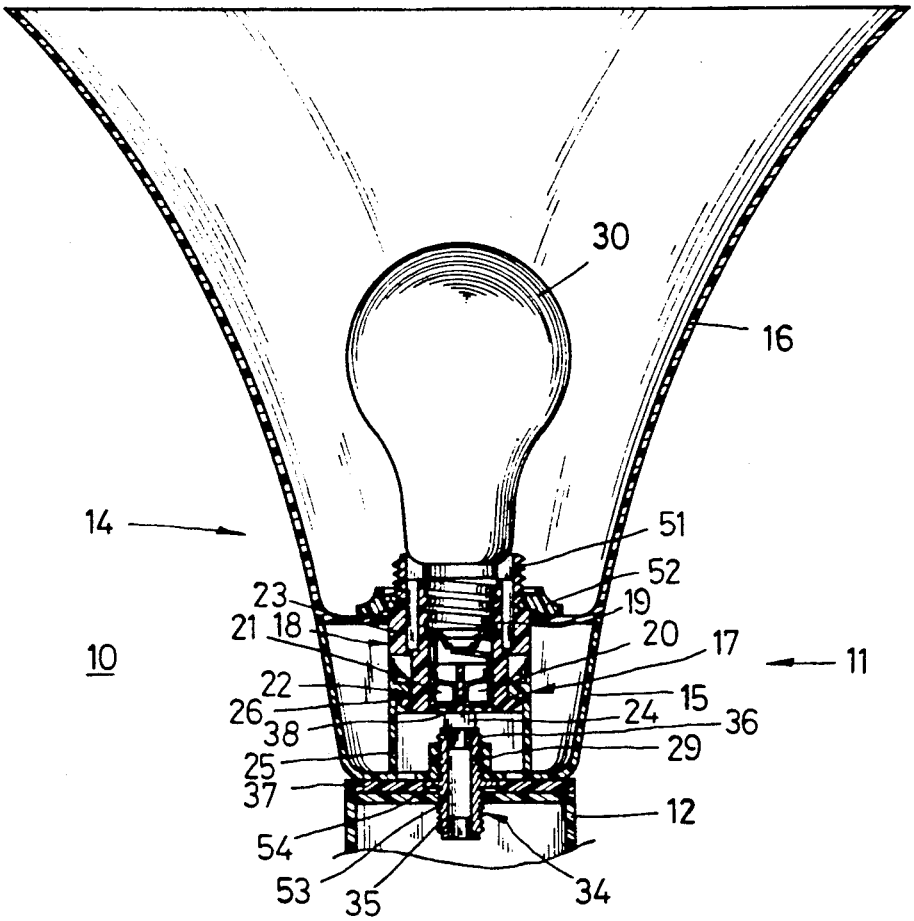
FIG. 1 is a sectional view of an embodiment-1 of a floor lamp according to the present invention.
Figure 3:
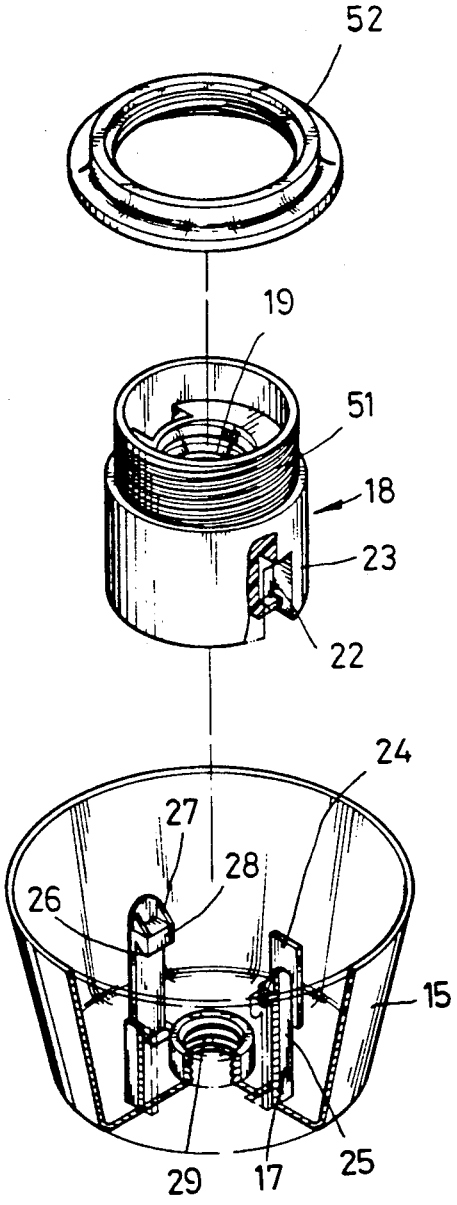
FIG. 3 is a disassembled view of the embodiment-1 according to the present invention.
Figure 5:
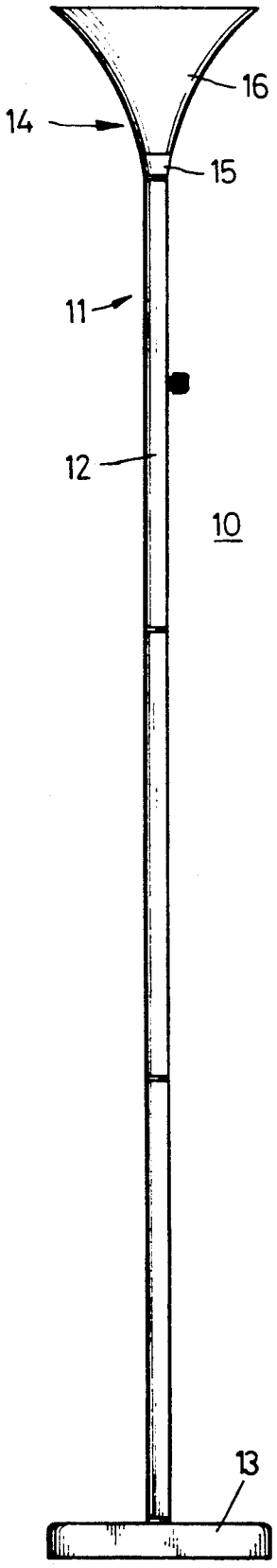
FIG. 5 is a perspective view of the present invention, being mounted on a floor lamp.

A new lamp shade structure according to embodiment-1 of the present invention as shown in FIGS. 1, 3 and 5 comprises a base 13, several supporting rods 12 and a lamp shade 14. The lamp shade 14 has a socket assembly 18 therein. The outside of the supporting rod 12 is mounted with a switch. The power wires of the floor lamp 11 are laid from the base 13 through the supporting rod 12, the lamp shade 14 and the socket assembly 18. The switch is used to control the ON/-OFF of the lamp.

The lamp shade 14 includes a lower shade portion 15 and an upper shade portion 16. The upper portion of the socket body 23 of the socket assembly 18 has outer threads 51. In order to facilitate the socket assembly 18 and the socket body 23 to plug and snap in place, the upper shade portion 16 has a center hole to mount around the outer threads 51 on the socket body 23, and then they are fixed in place with a fixing nut 52 so as to have the upper shade portion 16 fixed on the upper part of the lower shade portion 15.

The lower shade portion 15 and the socket assembly 18 are connected together with a snap joint as shown in FIGS. 1 and 3. The lower shade portion 15 has a conical portion, a flat bottom, and a screw hole 29 in the flat bottom. The screw hole 29 is used for receiving and fixing a connecting rod 34. In a floor lamp 11, the bottom part of the lower shade portion 15 is directly connected with a supporting rod 12. The threaded rod 35 of the connecting rod 34 is used as connection means between the lower shade portion 15 and the supporting rod 12. In order to facilitate the connection, a washer 37 is mounted between the lower shade portion 15 and the supporting rod 12. In the threaded rod 35, there is a separation ring 54 so as to have the two ends of the threaded rod 35 to connect with the screw hole 29 of the lower shade portion 15 and the threaded hole 53 of the supporting rod 12 respectively; then, the lower shade portion 15 and the supporting rod 12 can be connected together into one piece.

Around the outer circle of the screw hole 29 of the lower shade portion 15, there are snap fasteners 17 which each is molded integrally with the lower shade portion 15. The snap fastener 17 includes two symmetrical plate members 25, of which each has a hook 26, a flat surface 28, and two reinforced strips 27 on the top thereof. The two symmetrical snap fasteners 17 are to be snapped together with the socket body 23. On the bottom of the lower shade portion 15, there are two symmetrical supporting plates 24 beside the two snap fasteners 17 at an angle of 90°; the supporting plates 24 have a given height to facilitate the lower end of the socket assembly 18 to rest thereon after the socket body 23 being engaged with the snap fasteners 17. There is a given space between the supporting plates 24 and the snap fasteners 17 after the socket assembly 18 being mounted with a bulb 30, and such space is used for dissipating heat.

The upper part of the socket body 23 of the socket assembly is furnished with outer threads 51, which are used for mounting a fixing nut 52 after the socket assembly 18 being snapped in the lower shade portion 15, and after the upper shade portion 16 being mounted over the socket assembly 18 so as to fix the assembly 18 in place. The center of the socket assembly 18 has a bulb socket 19, which includes two power electrodes 20 and 21 to be in contact with the bulb 30 after the same being mounted in the socket 19. Under the two power electrodes 20 and 21, there is a through hole 38 for receiving power wires. The socket assembly 18 and the snap fasteners 17 of the lower shade portion 15 can be snapped together by means of two symmetrical hook grooves 22. When the hook grooves 22 are engaged with the hooks 26, they are fastened together into one piece.

According to embodiment-1 of the present invention, the outer threads 36 of the connecting rod 34 are to be engaged with the threaded hole 53 on the top of the supporting rod 12, and a washer 37 is mounted between the aforesaid two parts. The through hole in the connecting rod 34 is used for laying power wires; the power wires might be laid through the connecting rod 34 first before the rod 34 being mounted in the threaded hole 53 of the supporting rod 12. The power wires are extended into the lamp shade 14. The outer threads of the connecting rod 34 are to be engaged with the screw hole 29 of the lower shade portion 15; during the engagement of the aforesaid two parts, the power wires would not be affected. After the lower shade portion 15 being fixed in place, the ends of the power wires will be connected with the two electrodes 20 and 21 under the socket assembly 18 by plugging in. The two symmetrical hook grooves 22 outside the socket body 23 must be aligned with two snap fasteners 17 in the lower shade portion 15 before mounting the socket assembly. The reinforced strips 27 and the flat surfaces 28 of the snap fasteners 17 might cause a minnor resistance to the plugging, and therefore a suitable pressure should be applied to the socket assembly 18 so as to cause the resilient snap fasteners 17 to yield outwards a little bit until the hooks 26 entering the hook grooves 22 respectively; then, the bottom of the socket assembly 18 would contact against the supporting plates 24 to prevent the socket assembly 18 from going down further. As soon as the hooks 26 are engaged with the hook grooves 22, the socket assembly 18 will be snapped together with the lower shade portion 15; then, the upper shade portion 16 is mounted over the outer threads 51 of the socket assembly 18, and over the lower shade portion 15; finally, a fixing nut 52 is mounted around the outer threads to fix the upper shade portion 16 in place. A bulb 30 is mounted in the socket assembly 18. Since the socket assembly 18 and the lower shade portion 15 can be connected together by means of snap joint, the lamp according to the present invention may be assembly easily without using tools; therefore, it is deemed a great convenience to a user.

In embodiment-1 according to the present invention, the lamp shade 14 includes a lower shade portion 15 and an upper shade portion 16. The snap fasteners 17 in the lower shade portion 15 are molded integrally; of course, the upper shade portion 16 and the lower shade portion 15 can also be molded integrally; in other words, the making and assembling of the lamp shade 14 have been made simple; the socket assembly 18 of the lamp 10 able to be snapped to the lamp shade 14 has provided another convenient feature. If the lower and upper shade portions 15 and 16 are molded integrally, the outer threads 51 on the socket body 23 may be omitted. The bulb socket 19 can directly be mounted with a bulb 30, and the structure of the socket assembly 18 may be changed like a socket 43 as shown in FIG. 4.

Figure 2:
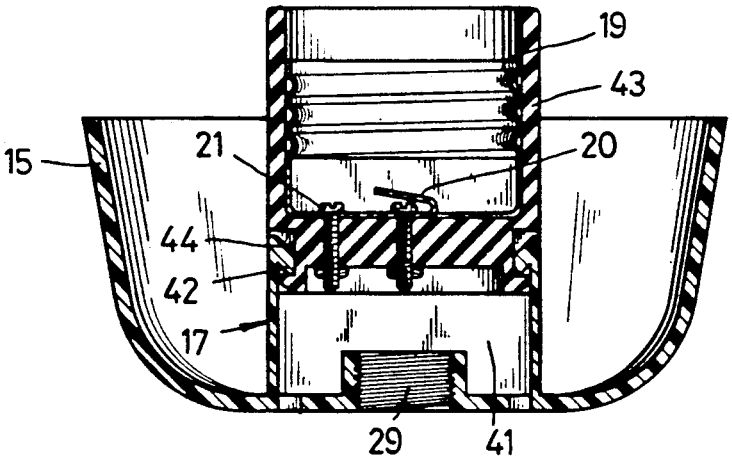
FIG. 2 is a sectional view of an embodiment-2 according to the present invention, showing the connection between the socket and the lamp shade.
Figure 4:
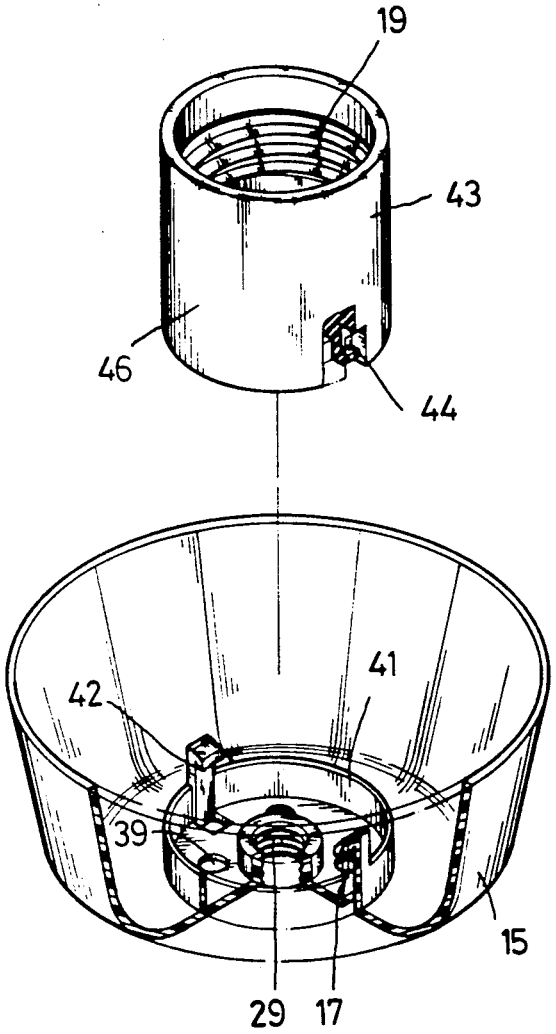
FIG. 4 is a disassembled view of the embodiment-2 according to the present invention.

The embodiment-2 according to the present invention as shown in FIGS. 2 and 4 is derived from the embodiment-1 as mentioned above. The upper part of the socket 43 has no outer threads 51, and a bulb 30 can be plugged therein directly. If the upper shade portion 16 and the lower shade portion 15 are not molded integrally, the upper shade portion 16 can be mounted on the lower shade portion 15 with screws or resilient fasteners. The connection method used between the socket body 46 and the lower shade portion 15 is the same as that of the aforesaid embodiment-1, i.e., the outer surface of the socket body 46 is provided with symmetrical hook grooves 44, while the lower shade portion 15 has the same snap fasteners 17 as that of the aforesaid embodiment-1. Further, the upper end of each snap fastener 17 has a hook portion 42. The socket 43 and the lower shade portion 15 can be connected together simply by having the snap fasteners 17 engaged with the hook grooves 44 of the socket 43.

The lower shade portion 15 has the same shape as that of the aforesaid embodiment, which includes a conical portion and a flat bottom. The center of the flat bottom has a screw hole 29 for receiving the outer threads 36 of the connecting rod 34. The outer circle of the screw hole 29 has two symmetrical snap fasteners 17 to be engaged with the hook grooves 44 on the socket 43. On the same outer circle, there is a ring-shaped member 41, which is used as a means to support and limit the socket 43 in place after the snap fasteners 17 being closely engaged with the hook grooves 44. The ring-shaped member 41 is erected from the flat bottom of the lower shade portion 15. The flat bottom is also furnished with a heat-dissipation hole 39 to release heat in the socket.

In embodiment-2, the socket 43 is a cylindrical member with two symmetrical hook grooves 44 on the lower part thereof, and with two symmetrical snap fasteners 17 on the flat bottom of the lower shade portion 15 so as to facilitate the socket 43 to snap on the lower shade portion 15.

Figure 6:
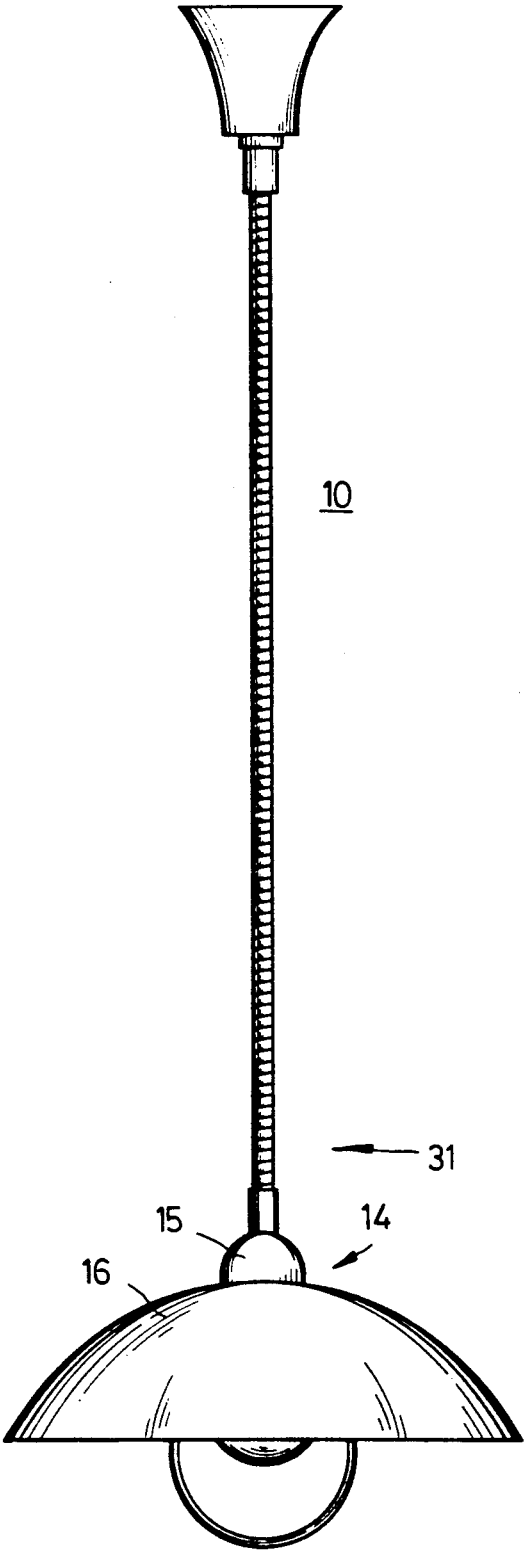
FIG. 6 is a perspective view of the present invention, being mounted on a ceiling lamp.
Figure 7:
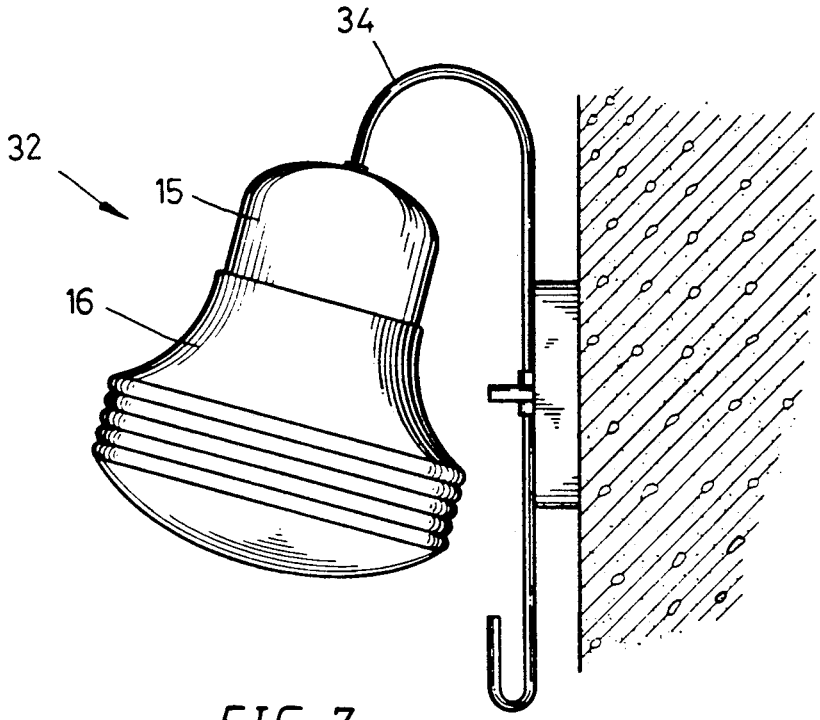
FIG. 7 is a perspective view of the present invention, being mounted on a bracket light.
Figure 8:
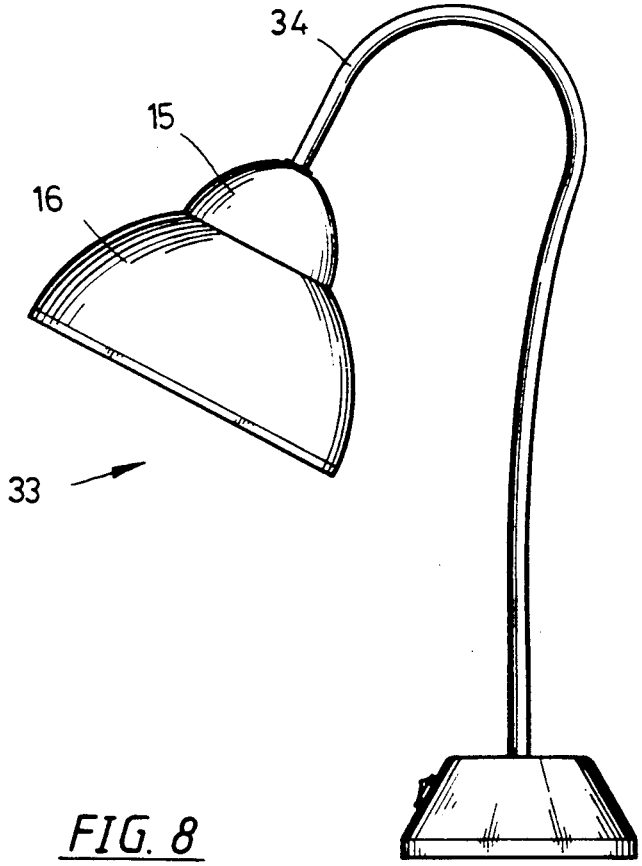
FIG. 8 is a perspective view of the present invention, being mounted on a table lamp.

According to embodiment-2, when the structure is used in a floor lamp, the socket 43 has no means for mounting the upper shade portion 16; instead, the upper shade portion 16 is replaced with an extended portion of the lower shade portion 15 upon being molded in form. The aforesaid lamp shade may also be used in a ceiling lamp as shown in FIG. 6. Further, the structure in embodiment-1 and embodiment-2 may also be used in a bracket lamp 32 as shown in FIG. 7, or in a table lamp 33 as shown in FIG. 8 to facilitate the connection between the socket assembly 18 and the lower shade portion 15.

It is deemed that the aforesaid embodiments used in a floor lamp, a ceiling lamp, a bracket lamp or a table lamp as shown in Figs. as mentioned above may have a minor modification in practical use.

The present invention is considered a substantial improvement to the connection structure of a conventional lamp socket, and a novel connection structure; however, any modification to the aforesaid embodiments is constructed still within the scope of claims attached to this application.

I claim:

1. A new lamp shade structure for mounting a snap-socket comprising:

a socket assembly having a bulb socket in the center thereof, and two symmetrical hook grooves on the lower outer side of a socket body of said socket assembly;

a lamp shade including a lower shade portion and an upper shade portion; and said lower shade portion being in a cup shape having a conical portion and a flat bottom, and a screw hole in center of said flat bottom for receiving a connecting rod having a threaded portion; and two symmetrical snap fasteners being furnished on an outer circle about said screw hole; said snap fasteners each having a hook; two symmetrical supporting plates being furnished on said outer circle at a regular angle with said snap fasteners; and said lower shade portion, said snap fasteners and said supporting plates being molded integrally into one piece; and characterized in that said screw hole in said flat bottom of said socket body is to be connected together with said threaded portion of said connecting rod upon said lower shade portion being attached thereto; and said flat bottom having two symmetrical snap fasteners each having a hook to be engaged with one of said symmetrical hook grooves on a lower outer part of said socket body; and said lower shade portion and said socket assembly being connected together by means of said hooks and said hook grooves.

2. A new lamp shade structure for mounting a snap-socket as claimed in claim 1, wherein said socket body is a cylindrical member.

3. A new lamp shade structure for mounting a snap-socket as claimed in claim 1, wherein said socket body is cylindrical in shape and outer threads being furnished on upper part thereof for mounting said upper shade portion.

4. A new lamp shade structure for mounting a snap-socket as claimed in claim 1, wherein a space is furnished between said supporting plates and said snap fasteners.

5. A new lamp shade structure for mounting a snap-socket as claimed in claim 1, wherein said supporting ring-shaped plates are members and both said snap fasteners and said ring-shaped member being connected together to form a closed space, several heat dissipation holes in said lower shade portion within said closed space.

6. A new lamp shade structure for mounting a snap-socket as claimed in claim 1, wherein said lamp shade includes a lower and upper shade portion molded integrally into one piece.

7. A new lamp shade structure for mounting a snap-socket as claimed in claim 1, wherein said upper shade portion is mounted on said lower shade portion by means of a resilient fastener or screw.

8. A new lamp shade structure for mounting a snap-socket as claimed in claim 1, wherein a fixing nut is mounted on said outer threads so as to fix said upper shade portion in place.

* * * * *